US008092117B2

(12) United States Patent
Hill et al.

(10) Patent No.: US 8,092,117 B2
(45) Date of Patent: Jan. 10, 2012

(54) HOPPER INSERT AND ROAD PAVER

(75) Inventors: Michael Hill, Spruce Creek, PA (US); Scott Weese, Shippensburg, PA (US)

(73) Assignee: Joseph Voegele AG, Mannheim (DE)

( * ) Notice: Subject to any disclaimer, the term of this patent is extended or adjusted under 35 U.S.C. 154(b) by 251 days.

(21) Appl. No.: 12/471,508

(22) Filed: May 26, 2009

(65) Prior Publication Data

US 2010/0239370 A1 Sep. 23, 2010

(30) Foreign Application Priority Data

Mar. 23, 2009 (DE) ..... 20 2009 004 083 U

(51) Int. Cl.
*E01C 19/18* (2006.01)

(52) U.S. Cl. ..... 404/108; 404/110

(58) Field of Classification Search ..... 404/101, 404/108, 110, 111; 198/536, 540, 550.2
See application file for complete search history.

(56) References Cited

U.S. PATENT DOCUMENTS 1,291,361 A * 1/1919 Babst ..... 404/108
2,089,094 A * 8/1937 Kime ..... 404/104
2,953,977 A * 9/1960 Warren ..... 404/110
3,058,404 A * 10/1962 Widelo ..... 404/108
3,608,446 A * 9/1971 Plant ..... 404/83
3,967,912 A * 7/1976 Parker ..... 404/84.05
5,158,394 A * 10/1992 Bresnahan ..... 404/108
5,356,238 A * 10/1994 Musil et al. ..... 404/84.1
5,362,176 A * 11/1994 Sovik ..... 404/72
7,441,987 B1 * 10/2008 Sampey ..... 404/98
7,568,858 B2 * 8/2009 Viitasalo et al. ..... 404/110
7,855,343 B2 * 12/2010 Nakagawa et al. ..... 177/25.18
2004/0146354 A1 * 7/2004 Goodwin et al. ..... 404/108
2009/0285631 A1 * 11/2009 Buschmann et al. ..... 404/108

* cited by examiner

*Primary Examiner* — Thomas Will
*Assistant Examiner* — Abigail A Risic
(74) *Attorney, Agent, or Firm* — Fish & Richardson P.C.

(57) ABSTRACT

A hopper insert is provided for a road paver. The hopper insert includes a funnel-shaped base body formed by four side walls. The upper side of the base body is open and at least three of the side walls extend inwardly therefrom to a bottom opening. One of the side walls includes a side outlet which is open to the bottom opening. The base body or the side outlet is adjustable in a width direction extending along the side wall containing the side outlet. The hopper insert is removably disposed in an integrated hopper of a road paver. The integrated hopper includes a rear wall with a gate that is adjacent the side wall of the hopper insert containing the side outlet. The side outlet is adjustable in the width direction to correspond to the width of the gate.

15 Claims, 2 Drawing Sheets

E
33
T
4
2c
13
9
2b
6'
W
1
M
6
20
H
19
8
2a
2
7
17
18
10
A
11
5c
13
6
12
6'
14
13
18'
5b
16
5a
15
5
3
32
31
30
B

HOPPER INSERT AND ROAD PAVER

Priority is claimed under 35 U.S.C. §119 to German Patent Application No. DE 20 2009 004083.6 filed Mar. 23, 2009.

FIELD

The invention relates generally to paving equipment and more specifically to a hopper insert for a road paver.

BACKGROUND

Road pavers conventionally are equipped with a hopper which is fixedly integrated into the chassis. The front wall of the hopper is relatively low for filling the hopper with material from a dump truck. The side walls of the hopper may be installed fixedly or can be pivoted in order to achieve both maximum capacity and minimum transportation width. There exist different road pavers for different applications, these road pavers having different hoppers and different longitudinal conveying devices. Accordingly, at least the widths of the gates associated to the longitudinal conveying devices also differ from each other. The respective gate is provided in the rear wall of the hopper. The capacity of the respective hopper may be too small for certain applications when the road paver should work continuously. Furthermore, the form of the heap of material poured by the dump truck into the hopper or the internal distribution of the material in the hopper may result in segregation or a strong cooling off of the material. For these reasons a road paver working continuously and without stops is frequently filled with paving material from a feeding vehicle travelling ahead of the road paver at a high rate. As the feeding vehicle drops the paving material from a higher altitude (higher than a truck), a hopper insert may be placed in the hopper. The hopper insert has a very large capacity or a larger capacity than the hopper itself and also allows to form a material heap which is optimal with a view to segregation or cooling-off, and which, in particular, allows that the road paver to travel and work continuously. It has been conventional to customise the respective hopper insert for each of the different types of road pavers, i.e., to match the width of the side outlet, in some cases even of the bottom opening, with the width of the gate, and to adapt the capacity of the hopper insert relatively precisely to the respective road paver type (leaflet "Feeding Vehicle MT1000", of the company Joseph Vögele A G, Neckarauerstrasse 168-228, D-68146 Mannheim, number 2428/1000/.01 Br; front page, pages 1, 2, 3, 4). This principle needs to provide different hopper insert types and to follow a certain logistic of each hopper insert for the road paver types. Known customised hopper inserts have given dimensions, and are very broad and high, such that it is complicated to load and to transport the hopper inserts (owing to limited passing heights and/or excessive width). In case of damage to a hopper insert a completely new hopper insert has to be provided. Furthermore, the respective hopper insert has to be designed such that the viewing range of the operator of the road paver will not be limited. Transport costs for large hopper inserts having given dimensions are high.

DE 102 00 361 A discloses to design vertical hopper walls of the hopper integrated into a road paver with a specific kinematic in order to laterally displace the vertical hopper walls or to pivot them about vertical axes, and to match the filling width precisely to the filling width of the vehicle pouring the paving material into the hopper. An adjustable cover may be provided within the hopper.

DE 297 13 808 U discloses a large road paver of which the lateral walls of the hopper and the caterpillar carriages can be adjusted in lateral directions.

DE 198 00 915 A discloses to sequentially introduce exchange containers into the integrated hopper of a road paver and to again remove the emptied exchange containers. The exchange containers are prefilled with paving material and are closed on all sides. The exchange containers may have double walls and/or thermal insulations and can be transported on conventional trucks.

SUMMARY OF THE INVENTION

According to an embodiment of the present invention, a hopper insert is provided for a road paver. The hopper insert includes a funnel-shaped base body formed by four side walls. The upper side of the base body is open and at least three of the side walls extend inwardly therefrom to a bottom opening. One of the side walls includes a side outlet which is open to the bottom opening. The base body or the side outlet is adjustable in a width direction extending along the side wall containing the side outlet. The base body may be adjustable in height and depth as well.

A road paver according to an embodiment of the present invention includes a chassis with an integrated hopper into which the hopper insert is placed with its bottom opening disposed on a bottom surface of the integrated hopper. The side wall containing the side outlet is adjacent a rear wall of the integrated hopper which contains a gate. The width of the side outlet is adjustable to correspond to the width of the gate.

BRIEF DESCRIPTION OF THE DRAWINGS

Embodiments of the invention will be explained with the help of the drawings. In the drawings.

DETAILED DESCRIPTION

Figure 1:
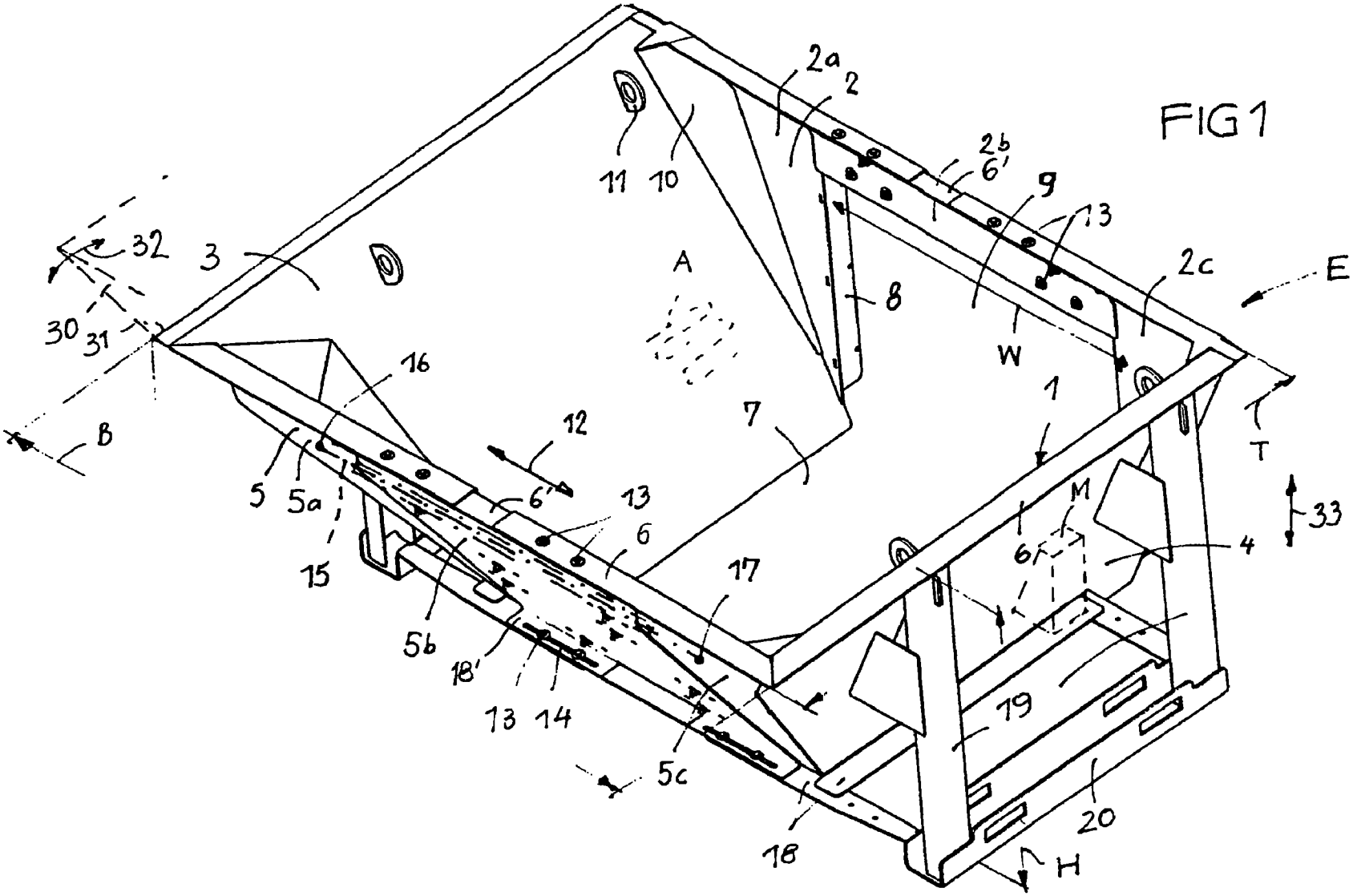
FIG. 1 is a perspective view of a hopper insert.

According to an embodiment of the present invention, a hopper insert fitting different types of road pavers is provided. A road paver equipped with a hopper insert which is independent from the type of road paver, but can be adapted to the requirements of the respective road paver type is also provided.

As at least the width of the side outlet of the hopper insert can be adjusted, a single basic type of hopper insert can be readily adjusted to the gate width of one respective road paver of different road paver types. If the base body can be adjusted in the region of the side outlet in width direction, not only the side outlet can be matched with the gate width in the respective road paver, but also the capacity can be set optimally for the respective application. As a further important advantage, the transport dimension of the hopper insert can be minimised at least in width direction in order to simplify transportation and to reduce transport costs. Owing to the adaptability of the hopper insert to the requirements of the respective road paver, the form of the material heap can be optimised in order to avoid segregation and a too strong cooling-off effect in the respective application. As in the case of a base body which can be adjusted in width direction, the base body consists of several parts. In the case of damage of a part, only the damaged part of the base body needs to be replaced. The space for storing the hopper insert and the size of the transport vehicles for transporting the hopper insert can be reduced expediently as soon as the hopper insert is adjusted to its minimum dimensions.

The road paver is characterised in that it is equipped independent from the road paver type with a basic type of hopper insert which is put in the existing integrated hopper and is adjusted to the given requirements in order to optimally guide and direct the paving material to the longitudinal conveying device. For small, medium and large road pavers the same basic type of a hopper insert can be used. This is expedient with a view to transportation, storing, logistics, and manufacturing costs of the hopper insert which, e.g., can be manufactured for in large quantities at a low price. The width of the side outlet is matched with the gate width in the rear wall of the hopper. Basically, the side outlet could be higher than the gate or only somewhat higher or even only as high as the highest existing gate among different road paver types. Road pavers equipped with the respectively adjusted hopper insert can work continuously when being filled from a feeding vehicle which travels ahead, even in the case of high specific paving material consumption.

In an embodiment, the height dimension and/or the depth dimension of the base body can also be adjusted. This at least one additional adjusting possibility facilitates the adaptation of the respective capacity to the requirement in the road paver and allows, furthermore, to further minimise the transportation and storing dimensions of the hopper insert upon demand. The adjustability of the height dimension, furthermore, allows an adaptation of the hopper insert to the respective road paver type, e.g., in order to prevent a significant, limitation to the necessary viewing range in the travelling direction for the operator of the road paver.

In an embodiment, wall sections of the base body are provided which overlap each other and can slide in relation to each other in order to allow for adjustment of the width dimension, and/or the height dimension and/or the depth dimension accordingly. In this case the base body may be at least divided into two parts in the respective adjustment direction.

In order to adjust the height dimension of the hopper insert, it is alternatively possible to tilt wall sections, preferably upper wall sections, about essentially horizontal axes, e.g., in order to reduce the tunnel passing height temporarily when the hopper insert is arranged in the hopper, or to reduce the transportation height of the hopper insert for transportation.

In order to achieve a hopper insert which is stable enough against occurring forces during the respective application of the road paver, it is expedient to incorporate the base body in an outer supporting frame having feet which may rest on the bottom of the hopper. The supporting frame, as well as the base body, may be adjustable at least in the width direction of the side outlet.

In an embodiment which allows for adjustment of the width of the side outlet, the hopper insert is subdivided in the adjustment direction into two parts. Two side walls lying opposite to each other in the base body wall sections are provided which overlap each other, can slide in relation to each other, and are guided relative to each other.

In another embodiment, which is adjustable at least in width direction of the side outlet, two outer wall sections and at least one inner wall section disposed between the outer wall sections are provided. The outer wall sections, preferably, are united with a respectively adjacent side wall. The inner wall section faces either the inner side of the base body or the outer side of the base body, or the inner and the outer sides of the base body. These three wall sections per side wall may be guided telescopically in relation to each other in the adjustment direction by means of angled edge rails at the side wall sections. The wall sections situated between the outer wall sections stabilize the entire base body during an adjustment and when having fixed a selected adjustment position. In this case, guiding regions and supporting regions with large surfaces are achieved between the wall sections.

In order to provide additional guidance to the adjustable wall sections, guiding slots may be provided in the wall sections and/or in the edge rails. The guiding slots contain tensioning screws. The plurality of guiding slots and the tensioning screws engaging in the guiding slots stably guide the wall sections during an adjustment and allow, after tightening the tensioning screws, a plurality of distributed fixation locations to be achieved, contributing to the entire stiffness of the base body during practical use.

In an embodiment, adjustment actuators are provided which are linked to the wall sections and/or to the edge rails. These adjusting actuators may be pneumatic cylinders, hydraulic cylinders, turn buckle systems, spindle drives, or the like, which can be actuated pneumatically, hydraulically, electrically or electromechanically or simply mechanically. This allows for adjustment steps such that the respectively desired dimensions can be provided precisely and rapidly. Forces resulting from deposited paving material can be overcome easily and rapidly when carrying out an adjustment by use of adjusting actuators.

In a further embodiment, the adjusting actuators may be provided with their own supplying module and control module for actuating and controlling the adjusting actuators. The module may be directly provided at the hopper insert, or can be functionally associated at least to the hopper insert. The module may include an electric, electronic or a wireless radio control in order to adjust the hopper insert accordingly both rapidly and precisely. In the case of radio control for remotely adjusting the hopper insert it can be operated with radio technology, Bluetooth technology, WLAN technology or similar technologies.

In order to achieve an optimum capacity and a rapid smooth flow of the paving material to the longitudinal conveying device, the side wall having the side outlet, the width of which can be adjusted, may be positioned steeper than the other side walls which either are equally inclined among each other or are differently inclined relative to each other in order to define the funnel shape of the hopper insert.

In an embodiment, the side walls of the hopper insert are at least heated at portions of the side walls by a heating assembly in order to avoid an undesirable cooling-off of the paving material or a segregation of the paving material, and in order to promote a smooth sliding effect of the paving material along the side walls. The heating assembly, e.g., can be operated from the supplying module and/or control module.

In another embodiment, the side walls of the hopper insert may be thermally insulated at least at portions of the side walls. The thermal insulation even may be provided in conjunction with a heating system.

In a further embodiment, the side walls of the hopper insert are double-walled at least at portions of the side walls in order to achieve higher stability of the base body and also to achieve a better thermal insulation. The double-walled side walls may contain thermal insulation material and/or a heating system using a heat transfer medium.

In the road paver it is expedient to place the side wall of the base body having the side outlet, the width of which can be adjusted, at least substantially parallel to the hopper rear wall when the hopper insert is put into the hopper of the road paver.

This allows the given size of the hopper to be used well by the hopper insert and results in a direct steady flow of the paving material from the hopper insert to the longitudinal conveying device or into the gate in the rear wall of the hopper.

In an embodiment of the road paver having a hopper insert placed in the hopper, which hopper insert can be adjusted at least in width direction of the gate by means of adjusting actuators, a supplying module and/ort control module is provided for adjusting the hopper insert, e.g., according to programmed and well-defined rules. The module may be arranged either as a separate component at the hopper insert or in functional association to the hopper insert, or is supplied from the supplying system of the road paver. In the latter case, the module may be placed at a convenient location in the road paver, e.g., as a portable unit. The remotely controlled adjustment of the hopper insert is a factor which enhances comfort, saves time and avoids erroneous operations by persons who are not sufficiently trained.

FIG. 1 shows a hopper insert E having a substantially funnel-shaped base body 1 with an open upper side and four side walls 2, 3, 4 and 5 which are situated substantially at right angles with respect to each other. The hopper insert E may be a welded sheet metal construction. The side wall 2 is situated substantially vertically in use, while the side walls 3, 4, 5 either are equally or differently inclined obliquely such that they extend obliquely inwards from above to a bottom opening 7. For stiffening purposes angled edge rails 6 may be arranged at the upper edges of the side walls. The side wall 2 has an open side outlet 9 having a width W. The side outlet 9 is arranged approximately centrally and is open at the lower edge to the bottom opening 7. The side outlet 9 may be stiffened by edge rails 8 as well. The base body 1 is integrated in an outer supporting frame having supporting pillars 19, feet 20, and frame spars 18.

In the embodiment shown in FIG. 1, the base body 1 is adjustable in width direction of the side outlet 9 (in the direction of double arrow 12). Alternatively, only the side outlet 9 could be adjustable at least in width direction within the base body 1. At the upper opening, the base body 1 has a width B (in width direction 12), a height H in vertical direction 33 and a depth T. In the embodiment shown in FIG. 1 the width B can be adjusted in width direction 12 in order to adjust the width W of the side outlet 9 and also the capacity, as desired. Triangular reinforcement parts 10 may be inserted into corner regions of the base body in order to improve the rigidity and to promote a better flow of poured-in paving material. Eyelets 11 provided at the side walls 3 and 4 may be used, e.g., for inserting and lifting the hopper insert E or for transportation of the hopper insert E, respectively.

The base body 1 in FIG. 1 is subdivided into two parts at least in the width adjustment direction. More precisely, the opposite side walls 2, 5 have respectively two outer wall sections 2*a*, 2*c* and 5*a* and 5*c* and a third wall section 2*b* or 5*b* disposed between the outer wall sections. The outer wall sections 2*a*, 2*c* and 5*a*, 5*c*, preferably, are united with the adjacent side walls 3, 4. The third wall section 2*b* or 5*b* overlaps the outer wall sections 2*a*, 2*c* and 5*a*, 5*c*. The wall sections 2*b*, 5*b* situated in-between may be arranged at the inner side of the base body 1, or, as shown, at the outer side of the base body 1. Also, the edge rails 6 are subdivided such that each angled edge rail 6' of the wall section 5*b*, 2*b* is guided at the other edge rail 6. In the lower region of the wall section 5*b* of the side wall 5, angled edge rails 18' are formed which are guided at the longitudinally extending, preferably interrupted frame spars of the supporting frame and which overlap these frame spars 18. Guiding slots 14 which are oriented in width adjustment direction are provided at least in the edge rails 6' and 18' and preferably in the respective side wall sections as well. Tensioning screws 13 engage in the guiding slots 14. The tensioning screws 13 limit the total adjustment range and will be tightened after a certain width B has been adjusted.

Optionally, the hopper insert E is equipped with adjusting actuators 15, of which in FIG. 1 only a single adjusting actuator 15 is shown, which, e.g., is linked to the outer wall sections 5*a*, 5*b* and/or the edge rails 6. Each adjusting actuator 15 serves to carry out the adjustments of the adjustable wall sections and, optionally, to finally position the adjusted wall sections. The adjusting actuator 15 may be a pneumatic cylinder, a hydraulic cylinder, a spindle drive including an electric motor, a turn buckle arrangement, or a similar, preferably remotely controlled, actuator device.

According to an embodiment, at side walls 2, 5, several parallel operating adjusting actuators 15 may be provided. The adjusting actuators 15 are supplied or controlled electrically, pneumatically or hydraulically, e.g. by a supply module and/or control module M which is associated to the hopper insert A and, e.g., is arranged outside at the side wall 4 or in the supporting frame and is connected with the adjusting actuators 15. The module M may contain its own hydraulic source (e.g., a hydraulic motor pump aggregate) and an electric or electronic control or even a radio control for remotely adjusting, in this case, only the width B of the hopper insert E. Alternatively, the module M could be a portable unit. In some embodiments, the module M is temporarily or permanently interlinked with the supplying system of the road paver and/or arranged in the road paver F (FIGS. 2, 3).

Figure 2:
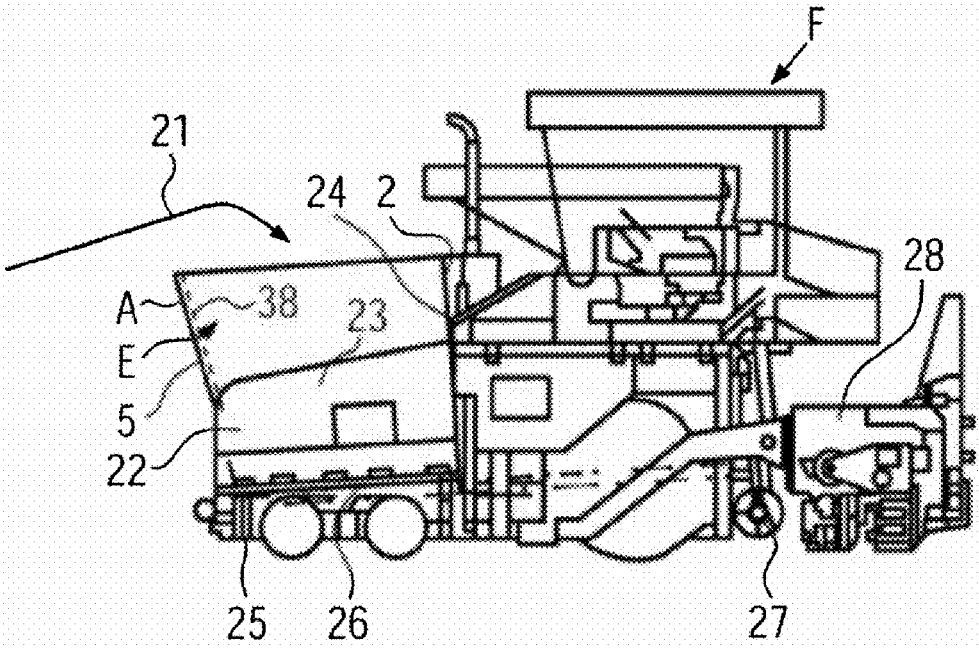
FIG. 2 is a schematic side view of a road paver having a hopper insert in the hopper.
Figure 3:
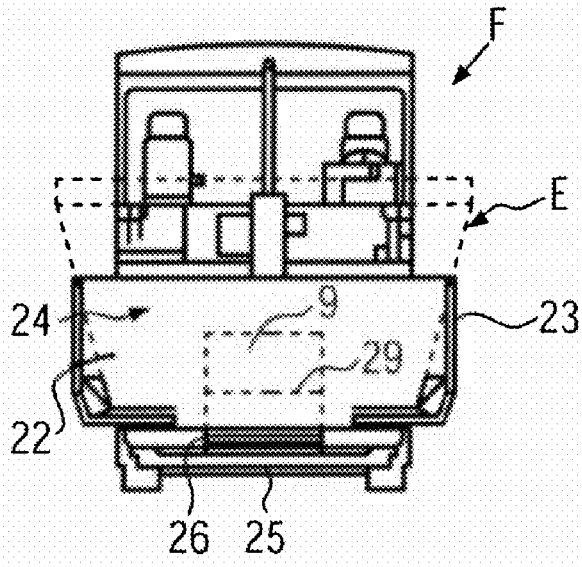
FIG. 3 is a schematic front view of the road paver of FIG. 2 with the hopper insert in the hopper, the hopper insert being indicated in dotted lines.

The side walls 2, 3, 4, 5 may, at least in some regions, be thermally insulated and/or equipped with a heating device (such as thermal insulation/heating device A in FIG. 1 or 2). Furthermore, the side walls 2, 3, 4, 5 could be double-walled in regions or completely doubled-walled.

In another embodiment, which is not shown in detail, the height dimensions of the base body 1 are also adjustable mechanically or remotely controlled and actuated in the adjustment direction of the double arrow 33. Additionally or alternatively, the depth T can be adjusted mechanically and/or remotely controlled, in order to adapt the main dimensions of the base body 1 to the respective application requirements, and also in order to further vary the capacity of the hopper insert. The additional adjustment possibilities for the height dimension and/or the depth dimension could be achieved with similar systems as shown FIG. 1 for the adjustability in width direction 12. Instead of angled edge rails 6, 6', 18, 18', telescopic tubes or U-profiles could be provided.

FIG. 1 indicates in dotted lines that the height dimension H of the base body 1 can also be adjusted by means of side wall sections 30 which can be tilted about substantially horizontal axes 31 (in tilting direction 32), e.g., in order to minimise the transportation height dimension of the hopper insert E or to further vary the capacity of the hopper insert. Adjustments of such tiltable side wall sections 30 may be executed mechanically or remotely controlled as well.

FIGS. 2 and 3 schematically show a road paver F comprising a chassis 25, an integrated hopper 22 in the chassis 25, and a longitudinal conveying device 26 extending from the bottom of the hopper 22 longitudinally through the chassis 25 to a lateral distribution assembly 27 mounted at the rear end of the chassis 25. The lateral distribution assembly 27 is situated in the working travelling direction (right to left in FIG. 2) in front of a paving screed 28 towed by the road paver F. The hopper 22 has fixedly mounted or pivotable hopper side walls 23 and, in this case, an essentially vertical hopper rear wall 24. The hopper insert E shown in FIG. 1 is put into the hopper 22 on the bottom of the hopper 22. At least the side wall 5 of the hopper insert E is double-walled (indicated at 38), at least in regions of the side wall 5, and may contain thermal insulation material and/or a heating device A. The hopper insert E is filled, e.g., with paving material by a feeding vehicle 21 travelling ahead of the road paver F for dumping paving material from an elevated position into the hopper insert E.

FIG. 3 shows that the hopper insert E may extend upwardly and outwardly beyond the dimension defined by the hopper side walls 23 of the hopper 22. The longitudinal conveying device 26 (e.g., a slat conveyor belt, in a single line or two parallel lines) arranged in the chassis 25 extends along the bottom of the hopper 22 and through a gate 29 in the hopper rear wall 24 further into the chassis 25. The gate 29 may be adjustable in order to regulate the rate of conveyed paving material, but in most cases has a predetermined gate width. For this reason, the gate 29 shown has a gate width which at least substantially corresponds with the width of the longitudinal conveying device 26 and a fixed or variable gate height. The side outlet 9 of the inserted hopper insert E is placed in front of the gate 29 and is either as high as the gate 29 or even higher (see FIG. 1).

In FIG. 2, the steep side wall 2 of the hopper insert E is at least substantially parallel to the hopper rear wall 24. The hopper insert E when inserted is releasably fixed in the chassis 25 by fixation means, e.g. tensioning belts and/or ropes and/or chains, and is moved into the hopper 22 and removed from the hopper 22 using a suitable hoisting device. At least the width B (see FIG. 1) of the dimensions B, T, H, of the hopper insert E is adapted to the requirements in the respective road paver type. For transporting or storing, the hopper insert E may be adjusted to minimal dimensions. In the case of damage to a part of the hopper insert E, only the damaged part needs to be replaced, while undamaged parts can continue to be used. It is, furthermore, possible to provide at least one cover lid at the open upper side of the hopper insert, which cover lid is pivoted open or removed when filling the hopper insert E with paving material. The heating device A in at least regions of the side walls of the hopper insert E can be supplied with a heat transfer medium, and/or can be heated by the heat of heat generating components of the road paver F, e.g. by heat generated by the driving motor, or can be heated by other heating devices (such as electric heating devices or gas heating devices). In embodiments with an adjustable height dimension of the hopper insert E (as explained with reference to FIG. 1), the height dimension can be adjusted when the hopper insert E is put into the hopper 22, so that the operator (sitting in the operator's platform of the road paver) has an unrestricted viewing range in the forward travelling direction.

While the invention has been particularly shown and described with reference to preferred embodiments thereof, it will be understood by those skilled in the art that various changes in form and details may be made therein without departing from the spirit and scope of the invention.

The invention claimed is:

1. A hopper insert for road pavers comprising:

a base body including four side walls, the base body being open at an upper side and at a bottom opening, at least three of the side walls extending inwardly from the open upper side to the bottom opening such that the base body is substantially funnel-shaped; and a side outlet disposed in one of the side walls, the side outlet being open to the bottom opening, and wherein at least one of the base body side walls and the side outlet is adjustable in a width direction extending horizontally along the wall containing the side outlet to vary the horizontal width of the side outlet.

2. The hopper insert according to claim 1, wherein the base body is adjustable in at least one of a height direction extending from the bottom opening to the upper side and a horizontal depth direction extending perpendicular to the horizontal width direction to vary the dimensions of the hopper insert.

3. The hopper insert according to claim 2, wherein the side walls include overlapping wall sections which are slidable at least in the horizontal width direction relative to each other.

4. The hopper insert according to claim 2, wherein the side walls are provided with wall sections near the upper side which are tiltable relative to a substantially horizontal axis so as to adjust the base body in the height direction.

5. The hopper insert according to claim 1, further comprising an outer supporting frame disposed about the base body, the outer supporting frame including feet and being adjustable together with the base body at least in the horizontal width direction.

6. The hopper insert according to claim 1, wherein the side wall containing the side outlet and the side wall opposite thereto include wall sections which overlap and are slidable in the horizontal width direction relative to each other so as to adjust the width of the base body and of the side outlet.

7. The hopper insert according to claim 6, wherein the wall sections include two outer side wall sections fixedly connected to adjacent side walls and a third side wall section extending between the outer side wall sections, the wall sections being telescopically guided by angled edge rails in the horizontal width direction.

8. The hopper insert according to claim 7, wherein guiding slots extending in a respective adjustment direction are provided in at least one of the wall sections and the edge rails with tensioning screws so as to guide the wall sections and allow the wall sections to be fixated.

9. The hopper insert according to claim 7, further comprising adjusting actuators connected to at least one of the wall sections and the edge rails.

10. The hopper insert according to claim 9, wherein the adjusting actuators are at least one of pneumatic cylinders, hydraulic cylinders, turn buckle assemblies and spindle drives.

11. The hopper insert according to claim 1, wherein a heating system is provided in at least regions of the side walls.

12. The hopper insert according to claim 1, wherein thermal insulation is provided in at least regions of the side walls.

13. The hopper insert according to claim 1, wherein at least regions of the side walls are double-walled and contain at least one of thermal insulation and a heating device.

14. A road paver comprising:

a chassis;

an integrated hopper disposed on the chassis and including a gate of predetermined width in horizontal width direction at a rear wall thereof;

a longitudinal conveying device disposed at the bottom of the integrated hopper, the longitudinal conveying device extending from the integrated hopper and through the gate; and a hopper insert removably disposed in the integrated hopper, the hopper insert including a funnel-shaped base body which includes a bottom opening arranged on a bottom surface of the integrated hopper and a side outlet arranged in a side wall adjacent the rear wall of the integrated hopper, wherein the side outlet being adjustable in a horizontal width direction extending along the side wall so as to adapt the width of the side outlet to correspond to the width of the gate in the width direction.

15. The road paver according to claim 14, wherein the hopper insert is functionally coupled to a module controlling adjusting actuators arranged in the hopper insert which adjust the width of the side outlet in the horizontal width direction.

* * * * *